US007854636B2

(12) United States Patent
Gilliam

(10) Patent No.: US 7,854,636 B2
(45) Date of Patent: Dec. 21, 2010

(54) HIGH POWER, SINGLE POLE ELECTRICAL CONNECTOR

(76) Inventor: Charles David Gilliam, 19423 Indian Ridge Ave., Baton Rouge, LA (US) 70817

( * ) Notice: Subject to any disclaimer, the term of this patent is extended or adjusted under 35 U.S.C. 154(b) by 0 days.

(21) Appl. No.: 12/319,453

(22) Filed: Jan. 7, 2009

(65) Prior Publication Data

US 2010/0173512 A1 Jul. 8, 2010

(51) Int. Cl.
*H01R 11/09* (2006.01)

(52) U.S. Cl. ..... 439/797; 439/908; 174/152 R

(58) Field of Classification Search ..... 439/335, 439/332, 296, 889, 337, 908; 174/152 R, 174/153 R See application file for complete search history.

(56) References Cited

U.S. PATENT DOCUMENTS 3,321,733 A * 5/1967 Edward ..... 439/271
3,696,321 A * 10/1972 Cooper, Jr. ..... 439/566
4,405,196 A * 9/1983 Fulton ..... 439/551
4,791,247 A * 12/1988 Cacalloro et al. ..... 174/152 R
4,972,049 A * 11/1990 Muench ..... 174/152 R
5,041,004 A * 8/1991 Waldorf ..... 439/306
5,213,520 A * 5/1993 Casey et al. ..... 439/559
5,423,692 A * 6/1995 Francis ..... 439/335
5,685,730 A * 11/1997 Cameron et al. ..... 439/335
6,610,933 B2 * 8/2003 Baker et al. ..... 174/142
6,796,279 B1 * 9/2004 Aiken ..... 123/169 PA
7,377,825 B2 * 5/2008 Bankstahl ..... 439/889
7,399,194 B1 * 7/2008 Gilliam ..... 439/263
7,487,716 B2 * 2/2009 Swank et al. ..... 99/421 P
7,578,711 B2 * 8/2009 Robinson ..... 439/801

* cited by examiner

*Primary Examiner*—Michael C Zarroli
(74) *Attorney, Agent, or Firm*—Roy Kiesel

(57) ABSTRACT

A high-power, single-pole electrical connector is disclosed. A nonconductive mounting base is used to attach the connector to an electrical distribution panel. The connector extending from the panel has a bolted together connection, rather than a pin-and-collet configuration, as is found in some existing connectors. In the present invention, a panel-mounted connection is secured to a working side connection by bolting the two parts together.

8 Claims, 6 Drawing Sheets

HIGH POWER, SINGLE POLE ELECTRICAL CONNECTOR

FIELD OF THE INVENTION

The invention relates generally to a single-pole electrical power connector, and more particularly, to a single-pole electrical connector used in oilfield applications.

BACKGROUND

Oil and gas drilling rigs are located throughout the world, both on land and at sea. There are important differences between the types of drilling rigs used for inland sites compared to those used for offshore drilling. An offshore drilling rig is typically very large, and may be made as a unitary structure. The electrical power generation and distribution system can be built on an offshore rig before the rig is moved into its operating location. This allows for hardwired connections and other permanent or semi-permanent electrical connections in the electrical distribution system.

Many inland oil and gas drilling rigs are much smaller than their offshore counterparts. It is common for inland rigs to be constructed in a more modular form, with the various parts of the rig being put together at the drilling location. A rig of this type may be hauled to the drilling site on one or more trucks. Because the rig is delivered in parts and assembled on site, the electrical distribution system is often prepared on site, as well. It is not common to have an electrical power distribution system pre-wired for a smaller inland drilling rig.

The field assembly and installation of many inland drilling rigs has led to widespread use of single pole electrical connectors that can be prepared in the field. A pin and collet style single pole connector has been used on inland oil and gas drilling platforms for many years. A typical connector of this type has a threaded shaft at one end and a threaded collet at the other end. This type of connector is shown in FIG. 6. One power line, typically the input line, is connected to the threaded shaft end of the connector. A pin is connected to the end of the other electrical cable, typically the output line, and this pin is placed inside the collet. A large collet nut is then tightened to create a secure connection. Some type of insulating boot or cover is then positioned over the collet and pin portion of the connection. Another boot or cover may be used to cover the threaded shaft connection, as well.

These single pole connectors are mounted in a distribution panel. The panels are typically made of melamine, fiberglass, or some other electrically nonconductive material. Holes are drilled into the panels, and the connectors are pressed into the holes. The panel connection portion of the single pole connector is typically knurled or grooved to create a more secure fit with the distribution panel. This fit is important to the operation and use of the connectors in this harsh environment.

The connectors are usually mounted into the distribution panels before the connection is made. This method of completing the electrical connection with a pin and collet type connector results in a great deal of torque applied to the connection between the connector and the distribution panel. When an oilfield worker tightens the large collet nut, the entire connector will tend to rotate. Such rotation is prevented only by the connection between the connector and the distribution panel. Because this connection to the panel is not very strong or secure, it is common to have the connector strip its connection to the distribution panel, and thus turn freely within the mounting hole in the panel. When this happens, it may be very difficult to make or unmake the pin and collet connection. In addition, when the connector strips its connection to the distribution panel, another hole in the panel must be drilled, and the connector reinstalled or a new connector installed. These failures and the necessary follow-up actions add time and cost to the overall operation.

Improvements have been made to single pole connectors to address the problem of a connector striping its connection to a distribution panel. The most common improvement is the machining of splines into the body of the connector. These splines engage the distribution panel when a connector is pressed into a hole in the panel. The splines, however, are not enough to prevent many connectors from stripping in distribution panels. Despite this problem, splined connectors of this type have been widely used in the oilfield for many years.

Another improvement consists of a set screw or key in the connector that engages a slot cut into the edge of the mounting hole in the distribution panel. This configuration creates more resistance to the torque applied when the collet nut is tightened, but it also requires additional installation time. A slot must be cut into the panel after the normal mounting hole has been drilled out. Even when this system is used, some of the connections to distribution panels will strip out.

The standard pin and collet configuration also results in a less than optimal connection. The collet nut must be tightened a great deal to provide a mechanically secure connection. If a pulling force is applied to the cable with the pin on its end, the pin may pull out of the collet, thus causing arcing and a loss of electrical connection. The arcing may create a fire risk or a direct risk to nearby personnel. To reduce the risk of pull out, workers tend to tighten the collet nuts as tight as possible. To do this, workers apply a great deal of torque to the collet nuts, which, in turn, causes more of the connectors to strip out the connections to the distribution panel. One shortcoming of this arrangement (i.e., the possibility of pin pull out) thus exacerbates another shortcoming (i.e., the stripping of the panel connection).

The threaded shaft end of these common single pole connectors also poses problems in use. A bus bar type connection is generally preferred for making a reliable, low-resistance connection. A standard lug connection may be crimped onto the end of an electrical cable, and the lug connected to the bus bar using a standard bolt and nut connection. It would be a further improvement on the common design to include a bus bar type connection on the end opposite the collet.

SUMMARY Of The INVENTION

A bolted-together connection (i.e., as compared to a pin and collet connection), may be more secure in the sense that such a connection cannot be pulled apart without shearing off the connecting bolts. The present invention combines the panel mounting advantages with a bolted-together connector design instead of a pin and collet design.

The present invention uses a lug-type connector on the base side of the panel mount, and a bolted-together connector on the working side of the panel. A mated connector is used on the end of the cable to be connected to the panel mounted connector. Two types of bolted-together connectors are described in detail below, but persons skilled in the art will recognize that the invention encompasses the use of any type of bolted-together connection in conjunction with the panel-mounted features of the present invention.

DETAILED DESCRIPTION OF THE INVENTION

Figure 4:
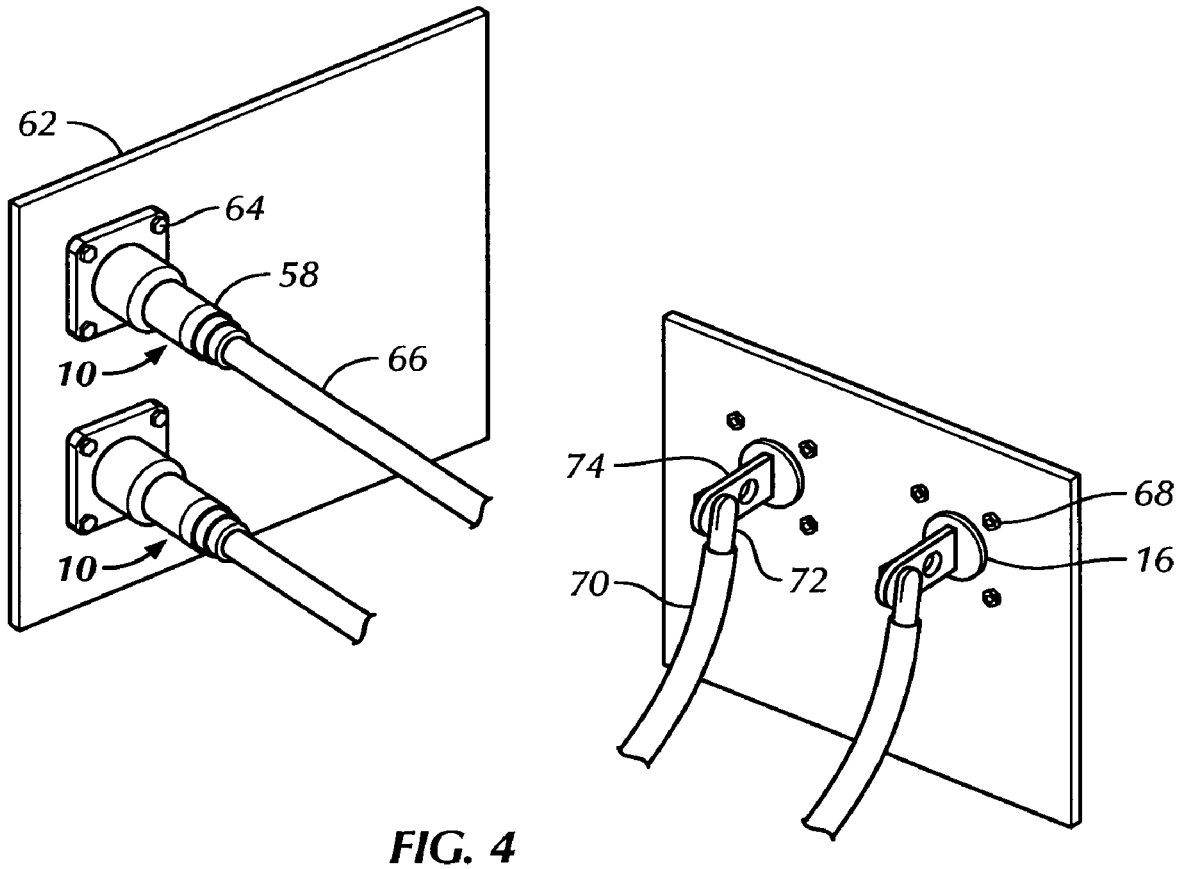
FIG. 4 is a perspective view of a distribution panel showing a pair of installed single pole electrical connectors according to the present invention.

The invention is an improved, high-power, single-pole electrical connector configured for mounting in a fixed panel. Such a panel configuration is shown in FIG. 4. Distribution panels with a number of high-power connectors are common in the oilfield. Prior art panels are typically made of a nonconductive material, such as melamine or a fiberglass-reinforced material. Nonconductive panels were needed because the panel mounted prior art connectors were not electrically insulated from the panels. Use of an electrically conductive panel with such prior art connectors would result in the energizing of the panel, and a short between connectors.

Electrically conductive materials, such as plate steel or aluminum, are stronger and more durable than the nonconductive panel materials typically used with prior art connectors. The present invention provides an electrically insulated panel-mount connector that allows use of electrically conductive panels.

A typical distribution panel, like the one shown in FIG. 4, has two sides that we refer to as the working side and the power side. The power side is the side typically behind the panel as the panel would be viewed by an operator. The power side is not exposed under normal operations. It is accessible for making up the initial connections, such as the power supply connections, but the power side is then secured and not accessible during normal operations. This feature is important, because it reduces the need for additional protections (e.g., insulating boots or other covers) for the power side of the panel-mounted connectors.

The working side of the panel, on the other hand, is exposed. Operators connect power cables to the working side of the panel-mounted connectors. A cable-end connection mated to the panel-mounted connection is installed on the end of the power cable. This cable-end connection is then connected to the working side of the panel-mounted connector, thus completing the electrical connection across the panel. Because the working side is exposed to personnel and the work environment, it is important to ensure the working side of the connectors are electrically insulated.

With this explanation of the two sides of the panel-mounted connectors of the present invention, we turn now to the specific embodiments described herein. Two embodiments of the present invention are described in detail. Both embodiments employ a working side configuration with bolt-on connections. These connections use bolts to secure the working side connection of the panel-mounted connector to the cable-end connector. By bolting these connections together, a very secure connection is created.

In the field, the power cables connected to distribution panels may exert tension at the panel connection. Cables may be moved, pulled, and may hang from panels. These and other conditions can create tension at the panel connection, which could result in the panel connection separating under power when prior art connectors are used. This result can be catastrophic, given the very high currents carried by some of these cables. The bolted together connections of the present invention greatly reduce the risk of such an occurrence.

Figure 1A:
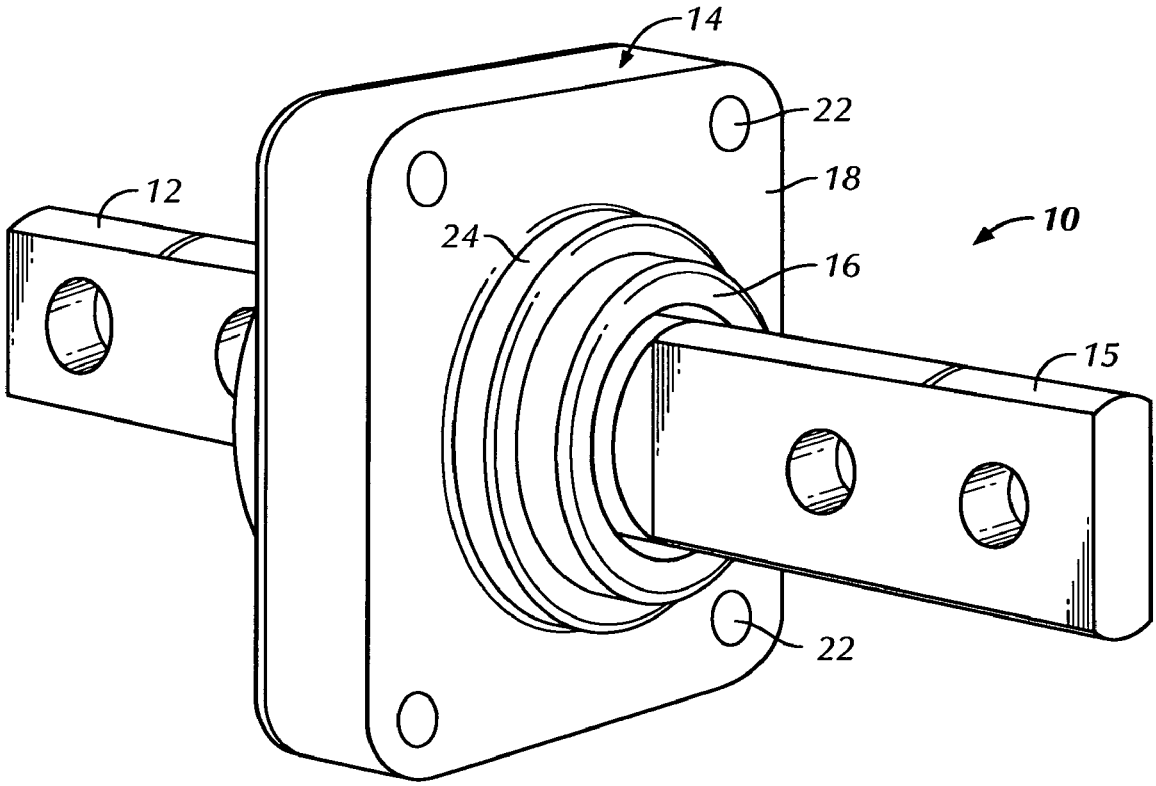
FIG. 1A is a perspective view of an embodiment of a single pole electrical connector according to the present invention.
Figure 1B:
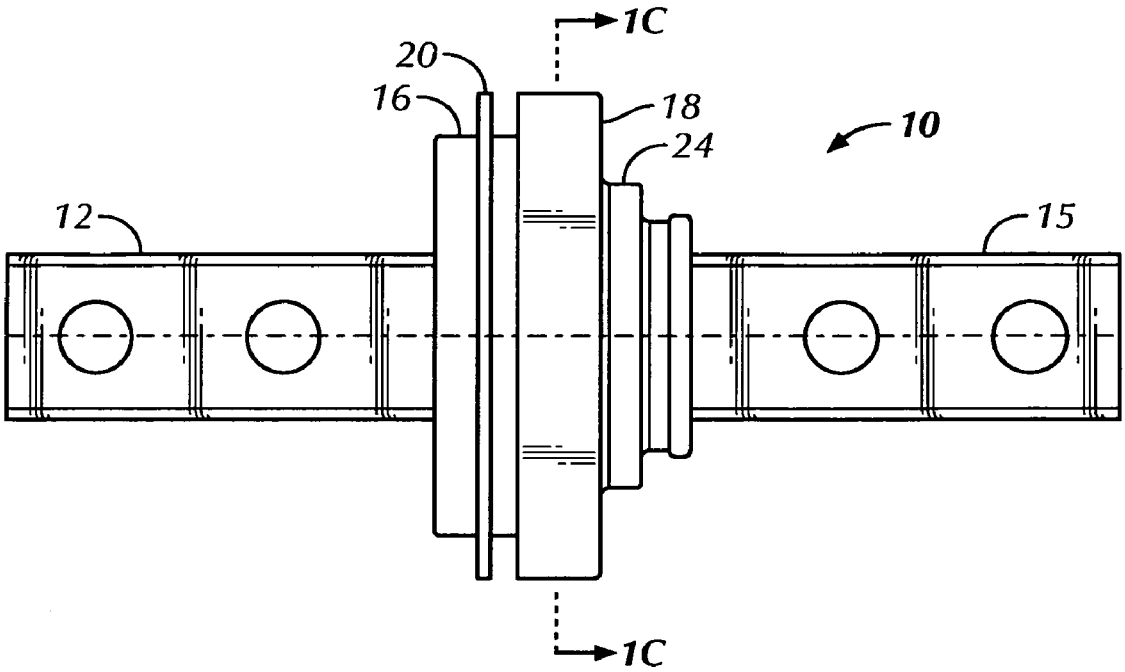
FIG. 1B is a side view of the connector shown in FIG. 1A.
Figure 1C:
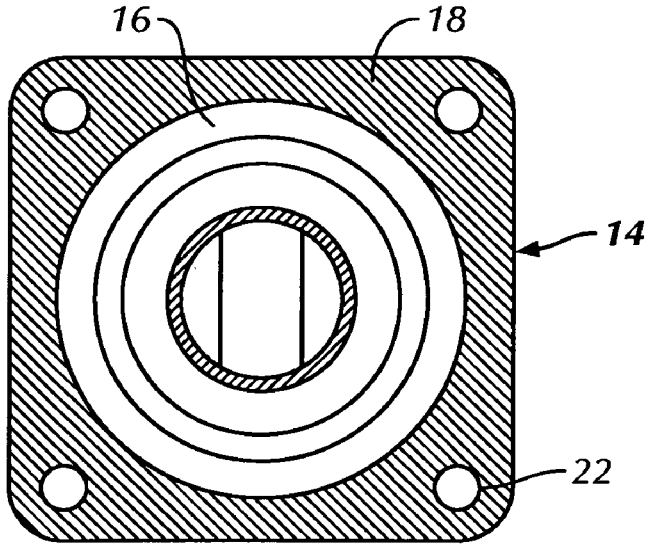
FIG. 1C is an end view of the connector shown in FIG. 1A.

The first embodiment is shown in FIGS. 1A-1C. This embodiment uses a standard lug type bus bar connector on both sides of the panel mount connector. FIG. 1A shows the single pole electrical connector 10 in perspective view. The connector 10 has a base electrical connection 12. In a preferred embodiment, the base electrical connection 12 is a bus bar type of connection, as is illustrated in FIGS. 1A and 1B. A threaded shaft connection also may be used, but the bus bar configuration is preferred.

The connector 10 also has a nonconductive mounting base 14, which is shown generally in FIG. 1C. The base 14 shown is generally square and is substantially larger than the mounting hole that must be bored in the distribution panel. Because the mounting base 14 is made of an electrically nonconductive material, the distribution panel need not be made of a nonconductive material. The panel may be made of steel or some other metallic material, which provides strength and may have other advantages over the melamine and fiberglass boards in wide use today. The nonconductive mounting base 14 is the only part of the connector 10 in contact with the panel, in the preferred embodiment.

As shown in FIG. 1A, the nonconductive mounting base 14 has a generally cylindrical panel insert 16 and a generally square mounting flange 18. Both of these parts are made of nonconductive material. The panel insert 16 fits snugly into a hole bored into a distribution panel, a characteristic more clearly shown in FIG. 1B. The flange 18, then presses against the panel. A panel gasket 20 (as shown in FIG. 1B) may be positioned over the panel insert 16 and up against the flange 18. When the connector 10 is secured to the panel, the gasket 20 would create a seal between the flange 18 and the panel, thus preventing moisture from getting past the panel. In a preferred embodiment of the present invention, the generally cylindrical panel insert 16 has an outer diameter of approximately 3.5 inches and the generally square mounting flange 18 has an outer side length of approximately 4.5 inches. The mounting flange 18 need not be square, as a circular, rectangular, or other shape would also work.

A series of mounting holes 22 are shown in the mounting flange 18. To install the connector 10, a hole is bored into the distribution panel, and the generally cylindrical panel insert 16 is placed inside this hole. Additional, smaller holes are drilled into the panel to align with the mounting holes 22. Bolts are then placed through the mounting holes 22 and the aligned holes in the distribution panel, and nuts are secured to the bolts to securely attached the connector 10 to the distribution panel. FIG. 4 shows connectors 10 according to the present invention attached to a distribution panel. The connections shown in FIG. 4 are described in more detail below.

The connector 10, as shown in FIGS. 1A and 1B, also has a boot collar 24, and a bus bar connection 15. In use, the boot collar 24 provides an attachment point of an insulating boot or cover on the working side of the panel. An illustrative insulating boot 58 is shown in FIG. 4, and will be discussed more below. The bus bar connection 15 is of the same, standard type used on the back side of the panel mount connector.

In this embodiment, a standard lug connector would be attached to the end of a cable that is to be connected to the panel mounted connector. The lug connector is of standard design. It is the same type connector shown on the back side of the panel in FIG. 4 and shown in more detail in FIG. 5, though also on the back side of the panel. In the embodiment shown in FIGS. 1A-1C, a lug connector and bus bar are used on both sides of the panel. An insulating boot (e.g., like the boot 58 shown in FIG. 4) may be used to cover and protect the working side connection once the lug is bolted to the bus bar.

Figure 2A:
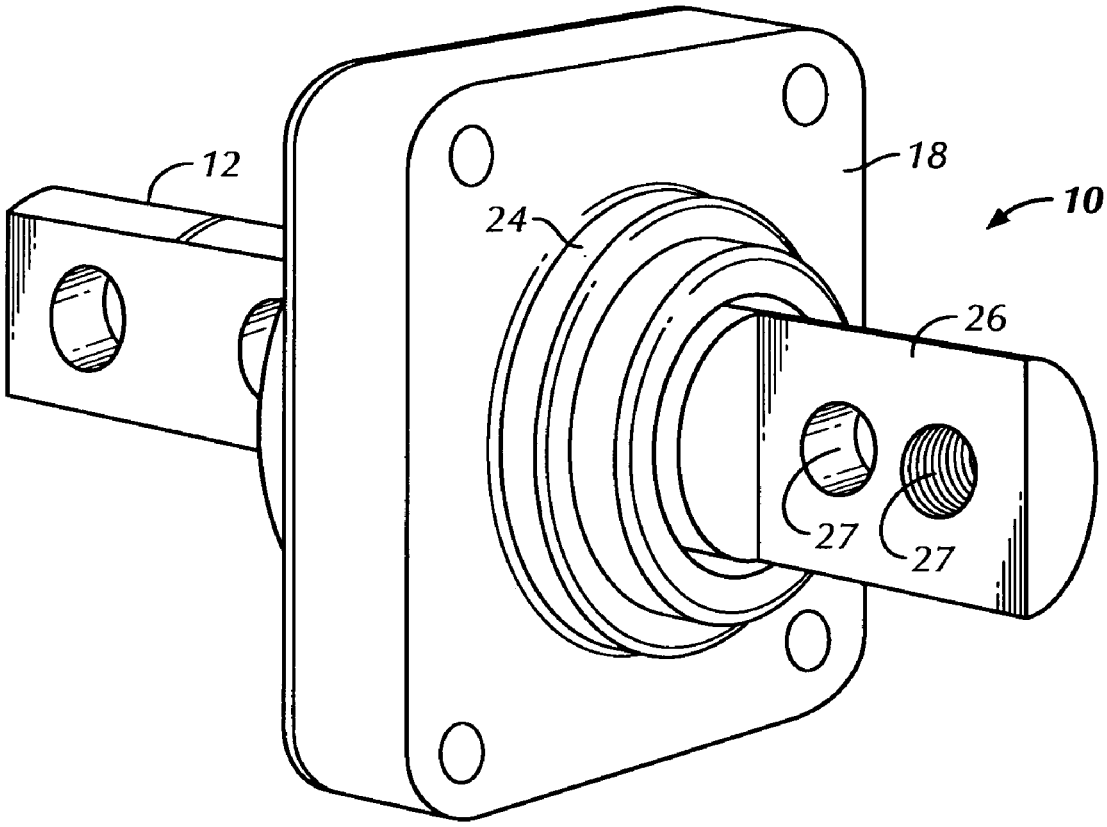
FIG. 2A is a perspective view of another embodiment of a single pole electrical connector according to the present invention.
Figure 2B:
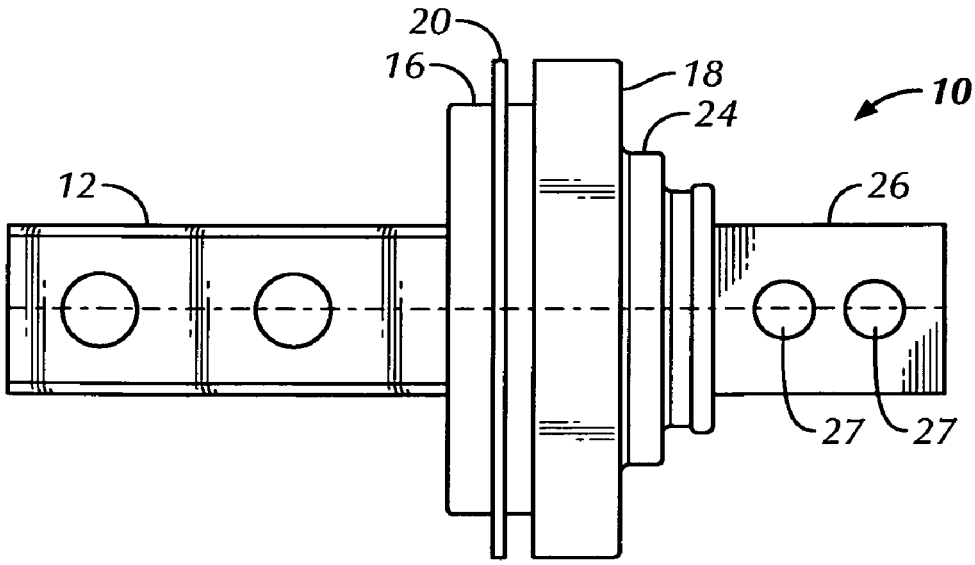
FIG. 2B is a side view of the connector shown in FIG. 2A.

A second embodiment of the invention is shown in FIGS. 2A-2B. A bus bar connection is preferred, and illustrated, for the back side of the panel mounted connector. On the working side, however, a unique semi-cylindrical connection 26 is used. The nonconductive panel mount parts of this embodiment are the same as those described above, and thus will not be described again here.

Figure 3:
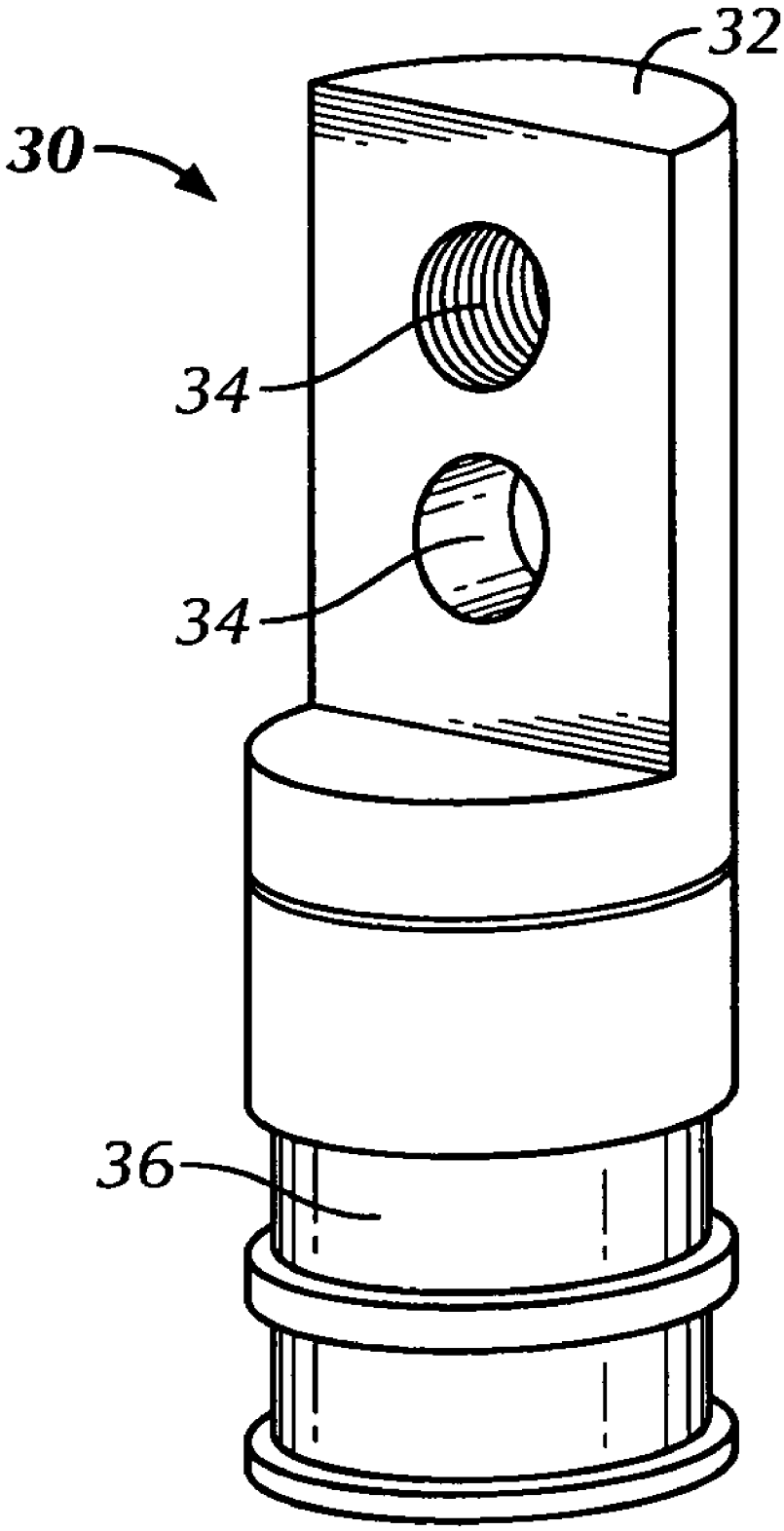
FIG. 3 is a perspective view of a cable end connector according to the present invention.

The semi-cylindrical connector 26 has two bored holes 27. One hole is threaded and one is not. The mated, cable-end connector 30 is shown in FIG. 3. This connector 30 also has a semi-cylindrical connector 32 and a pair of bored holes 34, with one hole threaded and one not. Cable crimping bands 36 are shown for securing the connector 30 to the end of a stripped power cable.

Figure 5:
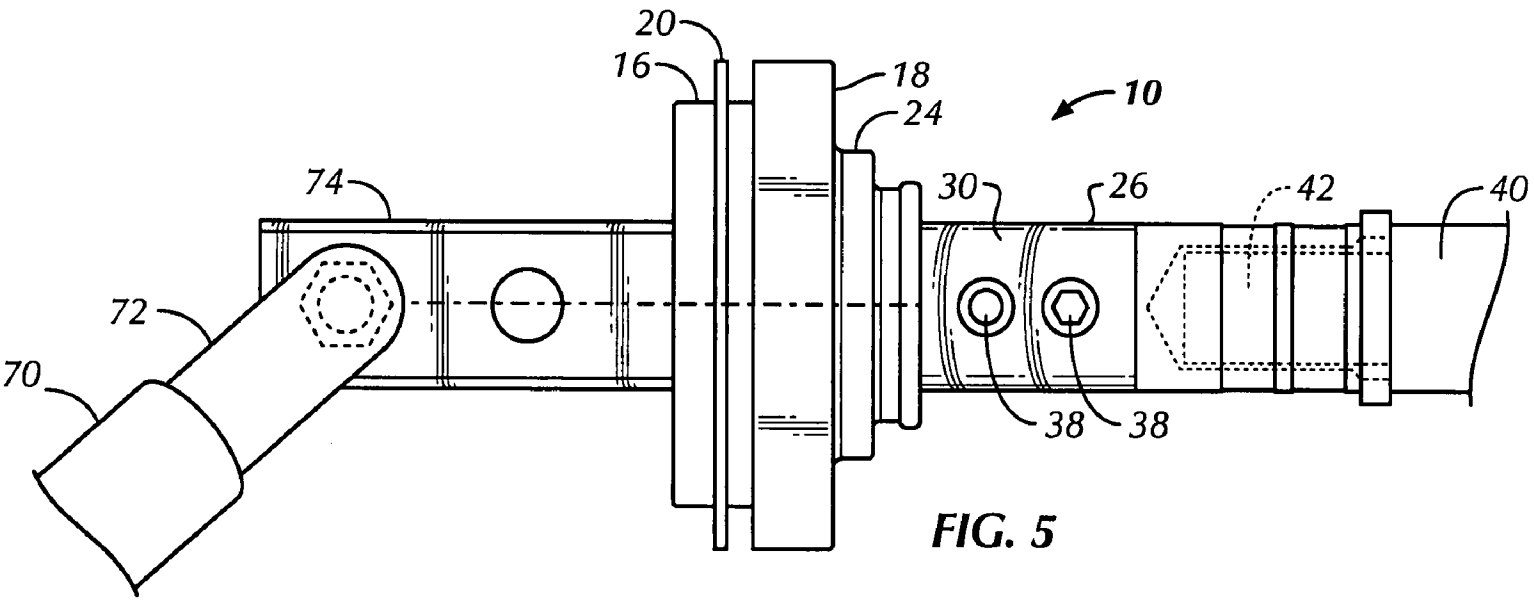
FIG. 5 is a side view of a connector with connecting lines shown connected.

This embodiment of the invention is shown made up in FIG. 5. The two semi-cylindrical connectors mate together to form a cylindrical made-up connection. The bored holes align so that the nonthreaded hole of the panel mount connector aligns with the threaded hole of the cable end connector, and vice versa. This configuration results in one securing bolt 38 being inserted and tightened from one side of the connection, while the other bolt 38 is inserted and tightened from the opposite side. This configuration is not required, but is preferred. It is shown in the made-up connection in FIG. 5.

By aligning the connection holes in this manner, the holes may be located closer together, allowing the connector to be shorter. This may provide some advantage in certain applications where space is at a premium. Tightening the securing bolts 38 from opposite sides also tends to provide a more balanced, and thus more secure, connection, though this result may not be a significant advantage in the field. The bolted-together nature of the connection provides a very secure connection that will not pull apart absent extraordinary circumstances. To pull such a connection apart at the point that it is bolted together would require shearing both securing bolts.

The made-up connection shown in FIG. 5 also shows a power cable 40 on the working side of the panel. The panel is not shown, but would be positioned on the left side of the flange 18, and against the washer 20. The cable 40 has a stripped end 42 which is crimped to the semi-cylindrical cable end connector 30, which is then secured to the panel mount semi-cylindrical connector 26 using securing bolts 38. FIG. 5 show the top of one bolt (i.e., the right bolt) and the bottom of the other (i.e., the left bolt). On the back side of the panel, a power cable 70 having a lug connector 72 is connected to the bus bar connection 74 of the panel mount connector. In practice, an insulating boot probably would be placed over the entire made up connection on the working side (i.e., the right side in FIG. 5) of the connection. A retaining ring may be used to secure the boot over the working side connection.

FIG. 4 shows an electrical distribution panel 62 from both sides. Two fully made up connectors according to the present invention are shown. The connector 10 is attached to the distribution panel 62 using mounting bolts 64 and mounting nuts 68. An output power line 66 is shown leaving the working side of connector 10 on one side of the panel 62. This side of the connector 10 is covered by the insulating boot 58.

An input power line 70 having a lug connection 72 at its end is shown on the power side of the panel 62. The lug connection 72 is connected to a bus bar 74 on the connector 10. This portion of the assembly is on the power side of the distribution panel, which is not typically accessible or exposed during normal operations. For this reason, individual insulating boots for each line may not be required on the power side. If, however, insulating boots are desired on the input line side, an insulating boot 58 and retaining ring 56 combination may be used just as was described above for the working side of the connector 10.

Figure 6:
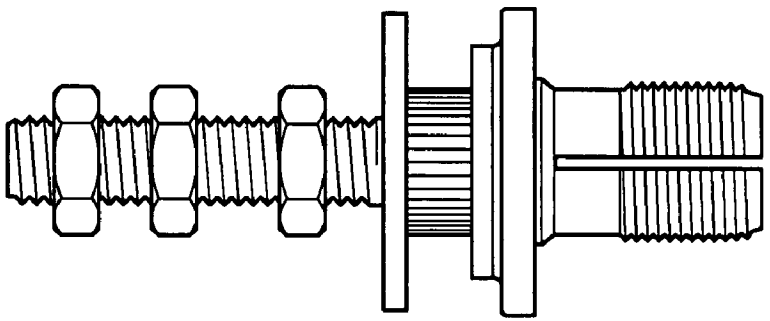
FIG. 6 (Prior Art)
FIG. 6 is a side view of a single pole electrical connector of the prior art.

The present invention also may embody color coding to help workers in the field recognize and distinguish different connections. The nonconductive mounting base 14 is considerably larger than the body of prior art single pole connectors (compare, for example, FIGS. 1A and 1B with FIG. 6). By color coding the base 14, workers can readily see the colored components. The base 14 is larger than the area covered by the insulating boot, so a color coded mounting base 14 will remain visible even when an insulating boot is in place over the working side of the connector 10. To further enhance the color coding benefits, the insulating boots also may be color coded to match the mounting bases. This configuration provides a highly visible color coding scheme.

The present invention may be constructed so that the conductive portions of the connector 10 are removable from the mounting base 14 in the field. The conductive parts of the connector 10 may be attached to the mounting base 14 using a locking ring that can be removed and reinstalled in the field. This would allow the mounting base 14 to remain in place if, for example, the internal parts of the connector need to be changed out. This capability would allow for relatively easy field replacement of key parts of the connector, and could reduce the need for spare parts.

While the preceding description is intended to provide an understanding of the present invention, it is to be understood that the present invention is not limited to the disclosed embodiments. To the contrary, the present invention is intended to cover modifications and variations on the structure and methods described above and all other equivalent arrangements that are within the scope and spirit of the following claims.

I claim:

1. A high-power, single-pole electrical connector comprising, a) a base electrical connection on a power side of the connector;

b) a nonconductive mounting base connected to the base electrical connection and configured to extend through a distribution panel when the connector is in use; and, c) a semi-cylindrical, bolt-on working side connection connected to the nonconductive mounting base and the base electrical connection wherein the semi-cylindrical working side connection has two holes for securing bolts, and said holes are configured so that the securing bolts are inserted from opposite sides of the semi-cylindrical connection, thus allowing for closer spacing of the holes and a shorter length for the semi-cylindrical connection.

2. A high-power, single-pole electrical connector comprising, a) a base electrical connection on a power side of the connector;

b) a nonconductive mounting base connected to the base electrical connection and configured to extend through a distribution panel when the connector is in use;

c) a semi-cylindrical, bolt-on working side connection connected to the nonconductive mounting base and the base electrical connection; and, d) a semi-cylindrical, cable-end connection configured for connection to the semi-cylindrical, working side connection such that when the connection is made up, the resulting working side connection has a generally cylindrical shape.

3. A high-power, single-pole electrical connector comprising, a) a base electrical connection on a power side of the connector;

b) a nonconductive mounting base connected to the base electrical connection and configured to extend through a distribution panel when the connector is in use;

c) a bolt-on working side connection connected to the nonconductive mounting base and the base electrical connection;

d) a bolt-on cable-end connection configured for connection to the bolt-on working side connection when the connector is in use;

e) an insulating boot configured to be positioned around the working side connection and the cable-end connection when the working side connection is made up, wherein the nonconductive mounting base is color-coded and is large enough that an outer portion of the color-coded base remains visible when the insulating boot is positioned around a made up working side connection; and, f) an insulating boot retaining ring.

4. A high-power, panel-mount, single-pole electrical connector comprising, a) a nonconductive mounting base;

b) an elongate conductor that extends through the nonconductive mounting base and has a power-side electrical contact surface at a first axial end of the elongate conductor and a working-side electrical contact surface at a second axial end of the elongate conductor and wherein:

i) the working-side electrical contact surface is configured to be bolted directly to an electrical contact surface of another connector.

5. The connector of claim 4, wherein the connector is rated for currents of 200 amps or more and voltages of 500 volts or more.

6. A high-power single-pole electrical connector comprising, a) a panel-mount component comprising;

i) a nonconductive mounting base; and, ii) an elongate conductor that extends through the nonconductive mounting base and has an electrical contact surface configured to be bolted to another conductor;

b) a cable-end component having an electrical contact surface at a distal end, the electrical contact surface being configured to be bolted to another conductor; and, c) at least one securing bolt for connecting the electrical contact surface of the panel-mount component to the electrical contact surface of the cable-end component.

7. The connector of claim 6 further comprising:

a) two securing bolts, and wherein i) the electrical contact surface of the panel-mount component further comprises two holes extending through the electrical contact surface in a direction generally perpendicular to the longitudinal axis of the elongate conductor;

ii) the electrical contact surface of the cable-end component further comprises two holes extending through the electrical contact surface in a direction generally perpendicular to the longitudinal axis of the cable-end component, such that the holes in the electrical contact surfaces may be aligned to allow the two securing bolts to connect the panel-mount component to the cable-end component.

8. The connector of claim 6, wherein the connector is rated for currents of 200 amps or more and voltages of 500 volts or more.

* * * * *